US010967637B2

(12) United States Patent
Nakashima et al.

(10) Patent No.: US 10,967,637 B2
(45) Date of Patent: Apr. 6, 2021

(54) LIQUID EJECTING APPARATUS

(71) Applicant: SEIKO EPSON CORPORATION, Tokyo (JP)

(72) Inventors: Hiromichi Nakashima, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/270,809

(22) Filed: Feb. 8, 2019

(65) Prior Publication Data

US 2019/0248144 A1 Aug. 15, 2019

(30) Foreign Application Priority Data

Feb. 13, 2018 (JP) ..... JP2018-023187

(51) Int. Cl.
*B41J 2/165* (2006.01)
*B41J 2/17* (2006.01)

(52) U.S. Cl.
CPC ..... *B41J 2/1721* (2013.01); *B41J 2/16508* (2013.01); *B41J 2/16523* (2013.01); *B41J 2002/1742* (2013.01)

(58) Field of Classification Search
CPC ..... B41J 2/16523; B41J 2/1721; B41J 2002/1742
See application file for complete search history.

(56) References Cited

U.S. PATENT DOCUMENTS

| | | | | |
|---|---|---|---|---|
| 2014/0099150 | A1 | 4/2014 | Matsumoto et al. | |
| 2015/0314605 | A1 | 11/2015 | Hirasawa et al. | |
| 2016/0339710 | A1* | 11/2016 | Sato | B41J 2/16538 |
| 2017/0129243 | A1 | 5/2017 | Otagiri et al. | |
| 2017/0203575 | A1 | 7/2017 | Shimazu | |

FOREIGN PATENT DOCUMENTS

| | | |
|---|---|---|
| JP | 2003-266747 | 9/2003 |
| JP | 2006-224556 | 8/2006 |
| JP | 2013-193215 | 9/2013 |
| JP | 2014-088017 | 5/2014 |
| JP | 2015-208991 | 11/2015 |
| JP | 2016-215410 | 12/2016 |
| JP | 2017-087494 | 5/2017 |
| JP | 2017-124541 | 7/2017 |

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid ejecting apparatus includes a liquid ejecting head configured to eject a liquid onto a medium; a maintenance unit that performs a maintenance operation for the liquid ejecting head; a mounting mechanism in which is mounted a waste liquid container that houses a portion of the liquid discharged as a waste liquid from the liquid ejecting head; and an access area that is provided vertically below a transport path along which the medium is transported and that is accessible from an apparatus front side, which is a downstream side in a transport direction in which the medium is transported, the mounting mechanism including a housing portion that houses the waste liquid container and being disposed so that a mounting port for mounting the waste liquid container in the housing portion opens to the access area.

7 Claims, 10 Drawing Sheets

LIQUID EJECTING APPARATUS

BACKGROUND

1. Technical Field

The present invention relates to a liquid ejecting apparatus such as a printer.

2. Related Art

For example, as disclosed in JP-A-2006-224556, there are printers that are an example of a liquid ejecting apparatus that ejects, as an example of a liquid, ink droplets from a recording head and records on roll paper. Some of such printers include storage units for storing a waste liquid such as ink that protrudes from the roll paper during borderless recording.

The storage units are detachably mounted through opening portions provided on both side portions of a printer main body. For this reason, for example, when the printer is arranged in a corner or a recessed space of a room and a rear side of the printer is attached to a wall surface of the room, replacement of the storage units cannot be performed easily in some cases.

Such a problem is not limited to a printer in which storage units for storing a waste liquid are mounted, but is generally common in a liquid ejecting apparatus in which a waste liquid container that houses a waste liquid is mounted.

SUMMARY

A liquid ejecting apparatus according to an aspect of the invention includes a liquid ejecting head configured to eject a liquid onto a medium; a maintenance unit that performs a maintenance operation for the liquid ejecting head; a mounting mechanism in which is mounted a waste liquid container that houses a portion of the liquid discharged as a waste liquid from the liquid ejecting head; and an access area that is provided vertically below a transport path along which the medium is transported and that is accessible from an apparatus front side, which is a downstream side in a transport direction in which the medium is transported, the mounting mechanism including a housing portion that houses the waste liquid container and being disposed so that a mounting port for mounting the waste liquid container in the housing portion opens to the access area.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejecting apparatus will be described with reference to the accompanying drawings. The liquid ejecting apparatus is, for example, an ink jet printer that performs printing by ejecting ink, which is an example of a liquid, onto a medium such as paper.

Figure 1:
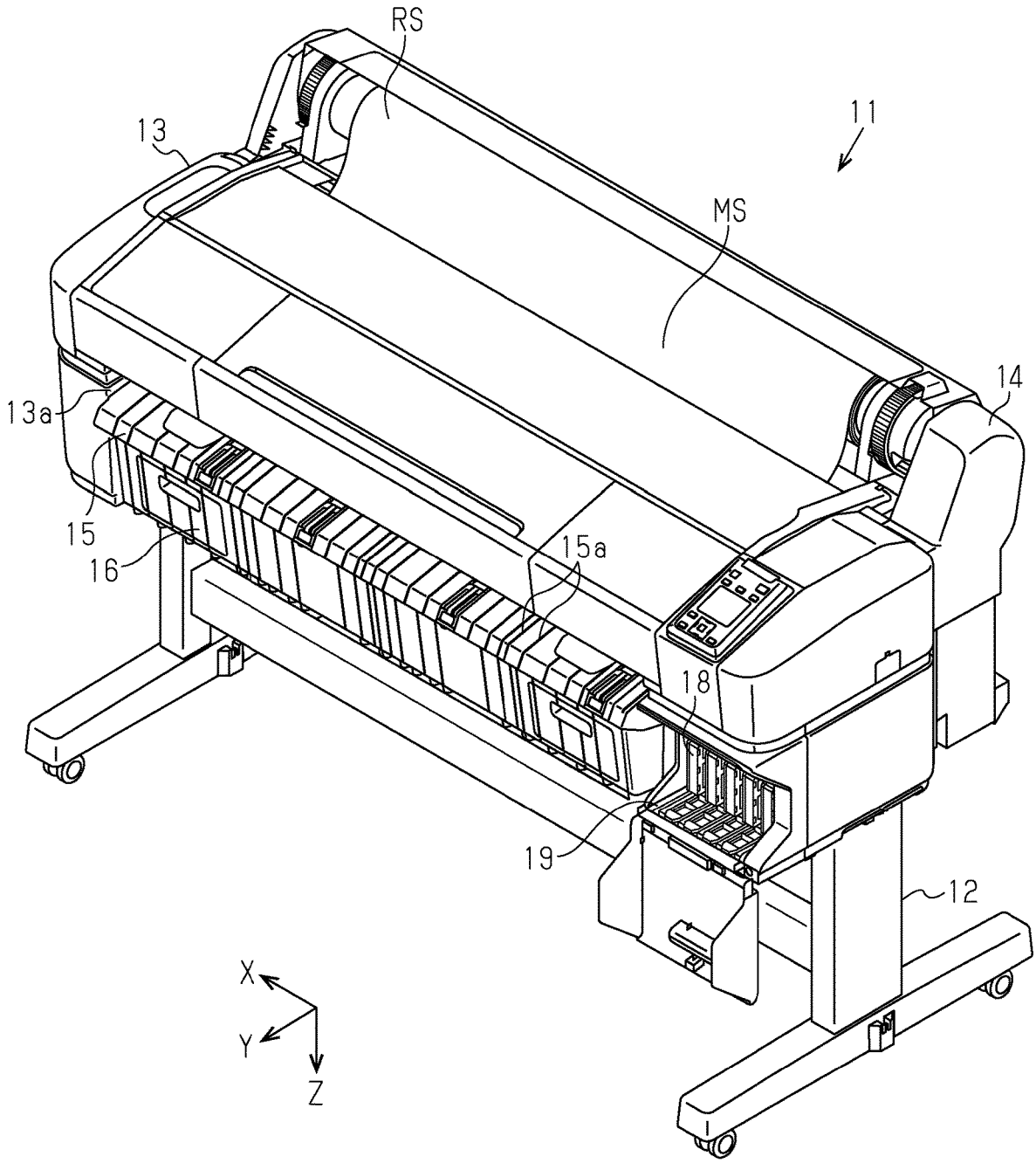
FIG. 1 is a perspective view of a liquid ejecting apparatus according to a first embodiment.

As illustrated in FIG. 1, a liquid ejecting apparatus 11 of the present embodiment includes a leg base 12, a casing portion 13 that has a substantially rectangular parallelepiped shape and that is supported by the leg base 12, and a feeding unit 14 that feeds a medium MS toward the casing portion 13. The feeding unit 14 holds the medium MS so as to be rotatable in a state of a roll body RS wound in a roll shape, and feeds the medium MS to the inside of the casing portion 13 by unwinding the medium MS by rotating the roll body RS that is held.

The casing portion 13 includes a support portion 15 that supports the medium MS fed by the feeding unit 14 positioned on a rear surface side and a front surface cover 16, which is an example of a cover that can be opened and closed on the front surface of the casing portion 13. A discharge port 13*a* for discharging the medium MS to the outside of the casing portion 13 opens on the front surface side of the casing portion 13.

In the drawings, the direction of gravity is indicated by the Z axis assuming that the liquid ejecting apparatus 11 is placed on a horizontal plane, and the directions along a plane intersecting with the Z axis are indicated by the X axis and the Y axis. The X axis, the Y axis, and the Z axis are preferably perpendicular to each other, and the X axis and the Y axis are along a horizontal plane. In the present embodiment, the X-axis direction is also referred to as a width direction X, the Y-axis direction is also referred to as a transport direction Y perpendicular to the width direction X, the Z-axis direction is also referred to as a gravity direction Z perpendicular to the width direction X and the transport direction Y. The transport direction Y is a direction in which the medium MS supported by the support portion 15 is transported, and the downstream side in the transport direction Y is also referred to as an apparatus front side. On an upper surface of the support portion 15, a plurality of ribs 15*a* that support the medium MS are formed so as to be aligned in the width direction X.

On one end side of the casing portion 13 in the width direction X, there is provided a container holding portion 19 in which a plurality of liquid containers 18 containing ink as an example of a liquid are mounted so as to be detachable. The plurality of the liquid containers 18 are provided for each type of liquid to be housed. The different types of liquids are, for example, liquids having different colors. The number and the size of the liquid containers 18 housed in the container holding portion 19 can be arbitrarily changed.

Each of the liquid containers 18 may be provided with an injection hole through which a liquid can be injected. The liquid container 18 may be configured so that a liquid can be supplied by injecting a liquid from the injection hole or printing can be performed by supplying a liquid from the outside via a supply tube connected to the injection hole.

In the case where an end of the casing portion 13 on the side where the container holding portion 19 is provided in the width direction X is defined as the end on the home side and the end on the opposite side as the end on the opposite side to the home, in the present embodiment, the container holding portion 19 is provided only at the end on the home side; however, the container holding portion 19 may be provided only at the end on the opposite side to the home or at both ends.

Figure 2:
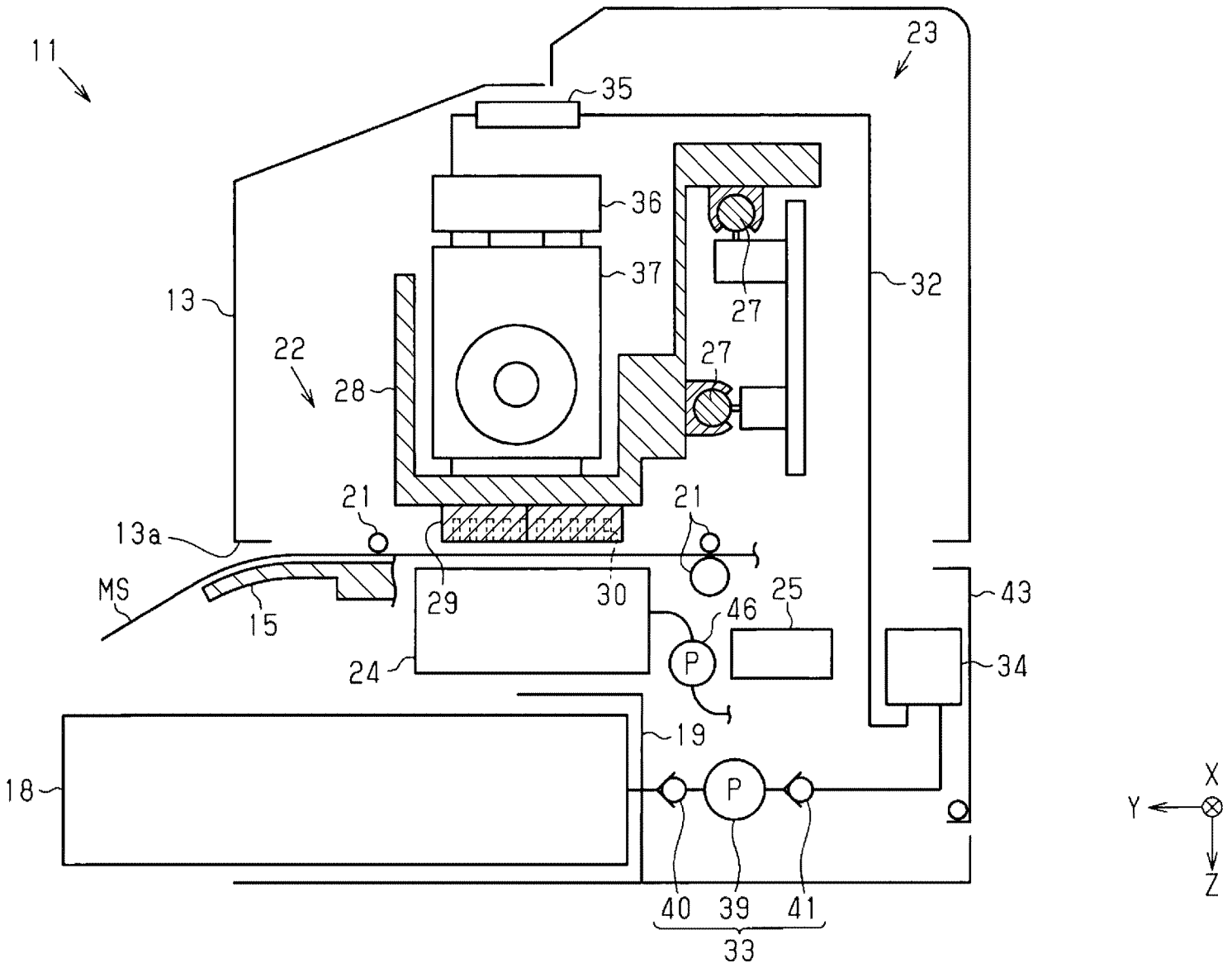
FIG. 2 is a schematic side view illustrating an internal configuration of the liquid ejecting apparatus.

As illustrated in FIG. 2, the liquid ejecting apparatus 11 includes a transport roller 21 that transports the medium MS, a liquid ejecting unit 22 that ejects a liquid for printing on the medium MS, a supply mechanism 23 that supplies the liquid housed in the liquid container 18 to the liquid ejecting unit 22, and a maintenance unit 24 that performs maintenance of the liquid ejecting unit 22. The liquid ejecting apparatus 11 includes a control unit 25 that integrally controls the driving of each mechanism such as the liquid ejecting unit 22 in the liquid ejecting apparatus 11.

The liquid ejecting apparatus 11 includes guide shafts 27 provided so as to extend in the width direction X. The liquid ejecting unit 22 includes a carriage 28 that is reciprocable in the width direction X while being guided by the guide shafts 27, and at least one liquid ejecting head 29 attached to a lower end portion of the carriage 28.

The liquid ejecting head 29 has a plurality of nozzles 30 capable of ejecting a liquid to the medium MS. The liquid ejecting head 29 ejects a liquid from the nozzles 30 toward the medium MS for printing on the medium MS while moving in the width direction X as a scanning direction.

Next, an embodiment of the supply mechanism 23 will be described.

As illustrated in FIG. 2, the supply mechanism 23 includes a supply path 32 through which a liquid is supplied to the liquid ejecting head 29 from the liquid container 18 mounted in the container holding portion 19. The supply mechanism 23 causes the liquid to flow in a supply direction from the upstream side, which is the liquid container 18 side, toward the downstream side, which is the liquid ejecting head 29 side. The supply path 32 is provided with, in order from the upstream side in the supply direction, a supply pump 33 that causes the liquid to flow, a filter unit 34 that captures air bubbles and foreign matter in the liquid, a static mixer 35 that stirs the liquid by changing the flow of the liquid in the supply path 32, a liquid storage chamber 36 that stores the liquid, and a pressure adjustment unit 37 that adjusts the pressure of the liquid.

The supply pump 33 includes a diaphragm pump 39 that has a pump chamber with a variable volume, a suction valve 40 disposed between the diaphragm pump 39 and the liquid container 18, and a discharge valve 41 disposed between the diaphragm pump 39 and the filter unit 34. The suction valve 40 and the discharge valve 41 are formed of one-way valves that allow the flow of ink to the downstream side but inhibit the flow of ink to the upstream side. As the volume of the pump chamber of the diaphragm pump 39 increases, the supply pump 33 sucks liquid from the liquid container 18 side through the suction valve 40, and as the volume of the pump chamber decreases, the liquid is discharged to the liquid ejecting head 29 side via the discharge valve 41.

The filter unit 34 is detachably mounted in the supply path 32. The filter unit 34 is disposed at a position corresponding to a rear surface cover 43 openably and closably attached to the rear surface of the casing portion 13, and can be replaced by opening the rear surface cover 43.

Figure 3:
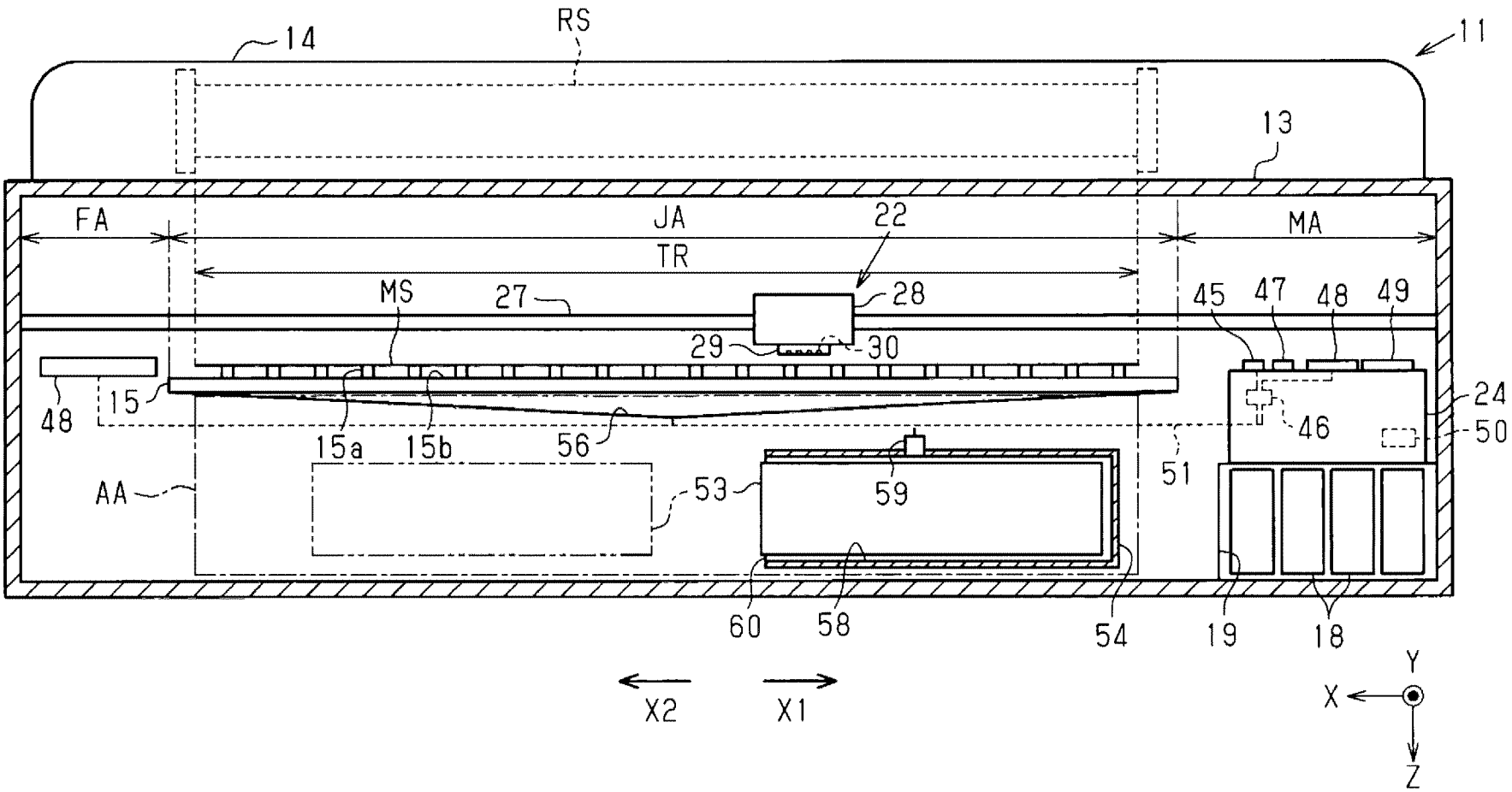
FIG. 3 is a schematic front view illustrating the internal configuration of the liquid ejecting apparatus.

As illustrated in FIG. 3, in the present embodiment, an area where the liquid ejecting head 29 ejects liquid onto the medium MS is defined as an ejection area JA. In a movement area of the liquid ejecting head 29 that moves in the width direction X, the area where the maintenance unit 24 is disposed is defined as a maintenance area MA, and the area on the opposite side to the maintenance area MA is defined as a flushing area FA. The ejection area JA of the present embodiment is an area where the support portion 15 is provided. For example, the liquid ejecting head 29 ejects a liquid so as to protrude from the medium MS when performing borderless printing in which margins are not left at the ends of the medium MS. Therefore, in the width direction X, the size of the ejection area JA may be larger than the maximum width of the medium MS. The maintenance area MA and the flushing area FA are areas outside the ejection area JA and are provided on both sides of the ejection area JA so as to be adjacent in the width direction X to the ejection area JA.

The maintenance unit 24 performs maintenance operations for the liquid ejecting head 29. The maintenance operations include, for example, a suction cleaning operation, a wiping operation, a flushing operation, and a capping operation. The maintenance unit 24 includes a suction cap 45 and a suction pump 46 that perform the suction cleaning operation, a wiping unit 47 that performs the wiping operation, a flushing unit 48 that receives the waste liquid generated by the flushing operation, a moisturizing cap 49 that performs the capping operation, and a driving source 50. The driving source 50 is, for example, one or a plurality of motors for driving the constituent members of the maintenance unit 24.

The maintenance unit 24 has a discharge flow path 51 through which a portion of the liquid discharged from the liquid ejecting head 29 by the suction cleaning operation and the flushing operation is sucked and discharged. The discharge flow path 51 is, for example, an elastically deformable tube communicating with the suction cap 45 and the flushing unit 48. The suction pump 46 may be a tube pump provided in the discharge flow path 51.

The suction cap 45 and the moisturizing cap 49 are configured to be movable relative to the liquid ejecting head 29. When the suction cap 45 and the moisturizing cap 49 are relatively moved in a direction bringing them close to the liquid ejecting head 29, capping is performed to form a closed space to which the nozzles 30 open.

When the suction pump 46 is driven with the suction cap 45 in a capped state, the closed space surrounded by the suction cap 45 and the liquid ejecting head 29 has a negative pressure, and due to the negative pressure, suction cleaning is performed in which a portion of the liquid is sucked and discharged from the nozzles 30.

The flushing unit 48 is preferably provided in the maintenance area MA on the home side and the flushing area FA on the opposite side to the home. Flushing refers to a maintenance operation in which the liquid ejecting head 29 forcibly ejects droplets from the nozzles 30 and ejects them separately from the ejection of the liquid to the medium MS for printing purposes in order to suppress or eliminate clogging of the nozzles 30.

The moisturizing cap 49 suppresses drying of the nozzles 30 by performing capping. When the liquid ejecting apparatus 11 does not perform printing, the liquid ejecting head 29 moves to a position corresponding to the moisturizing cap 49, and stands by in a state in which the liquid ejecting head 29 is capped by the moisturizing cap 49. Therefore, the position where the moisturizing cap 49 is present in the width direction X is referred to as the home position of the liquid ejecting head 29.

The liquid ejecting apparatus 11 includes a mounting mechanism 54 in which a waste liquid container 53 that houses a portion of the liquid discharged as a waste liquid from the liquid ejecting head 29 in accordance with the maintenance operation is detachably mounted. The waste liquid container 53 houses, as a waste liquid, the portion of the liquid discharged from the nozzles 30 by suction cleaning and flushing.

The waste liquid container 53 may be capable of housing a waste liquid generated when borderless printing is performed. In borderless printing, a portion of the liquid protruding from the medium MS is received by a liquid receiving portion 15*b* that is a portion where the ribs 15*a* of the support portion 15 are absent. When the liquid ejecting head 29 ejects the liquid toward the medium MS, the liquid receiving portion 15*b* receives, as a waste liquid, the portion of the liquid that has deviated from the medium MS. The liquid ejecting apparatus 11 includes a funnel-shaped downward flow path 56 that promotes natural down flow of the waste liquid received by the liquid receiving portion 15*b* and guides the waste liquid to the discharge flow path 51.

Figure 4:
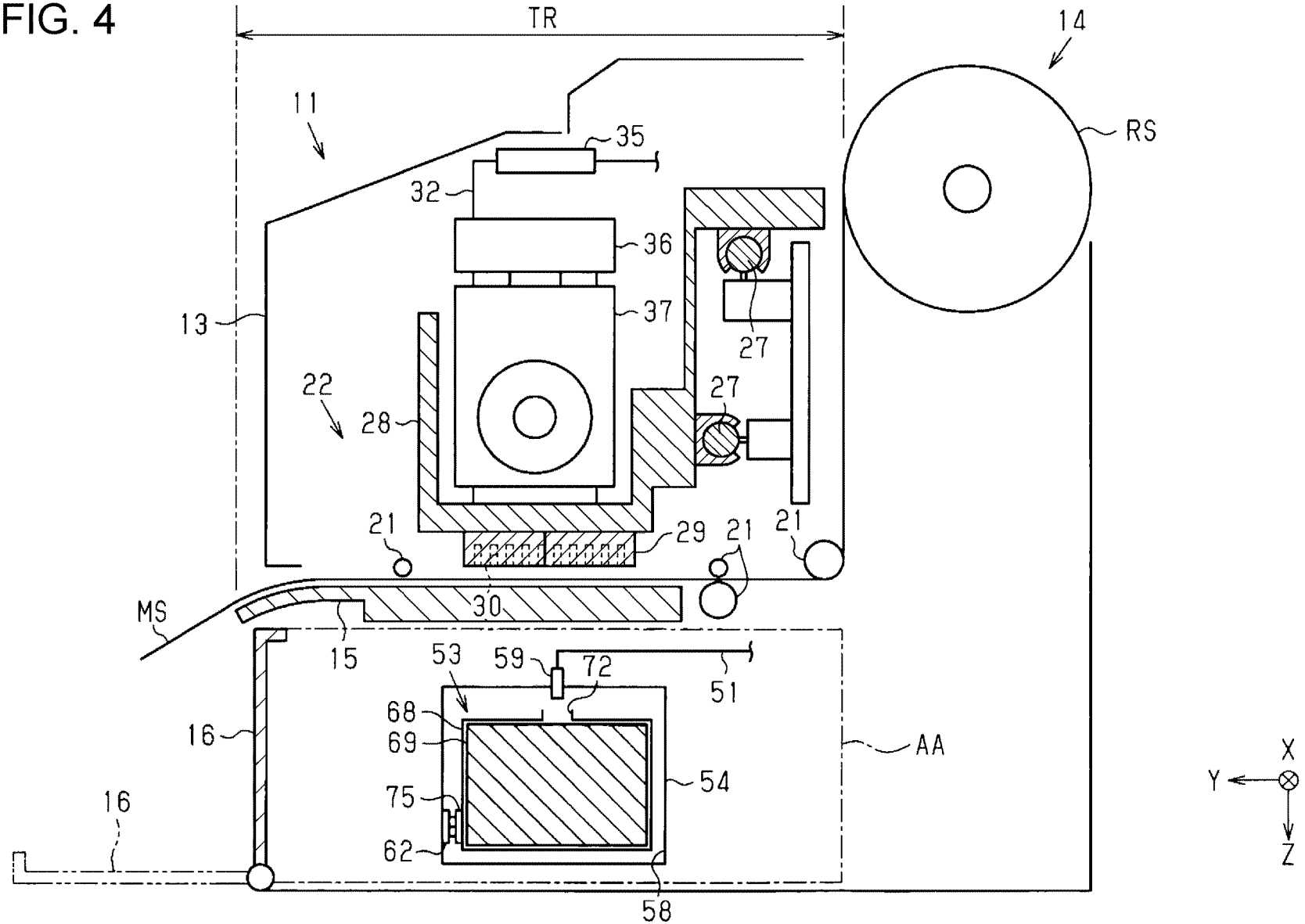
FIG. 4 is a schematic side view illustrating the internal configuration of the liquid ejecting apparatus.

As illustrated in FIG. 3 and FIG. 4, the liquid ejecting apparatus 11 includes an access area AA accessible from the apparatus front side by positioning the front surface cover 16 at an open position indicated by the two-dot chain line in FIG. 4. The front surface cover 16 is disposed on the apparatus front side of the access area AA. The front surface cover 16 is rotatable about an axis and can be positioned at a closed position illustrated by a solid line in FIG. 4 covering the access area AA from the apparatus front side and at the open position allowing access to the access area AA.

The access area AA is provided vertically below a transport path TR on which the medium MS is transported. The transport path TR is a path through which the medium MS passes when the medium MS having the maximum width is transported. That is, the size of the access area AA in the width direction X is the maximum width of the medium MS. The size of the access area AA in the transport direction Y is equal to the size from the position where the roll body RS is unwound to the end of the support portion 15 on the downstream side in the transport direction Y or the size up to the front surface cover 16.

Next, an embodiment of the mounting mechanism 54 and the waste liquid container 53 will be described.

As illustrated in FIG. 3 and FIG. 4, the mounting mechanism 54 has a housing portion 58 that houses the waste liquid container 53 and an introducing portion 59 for introducing a portion of the liquid discharged as a waste liquid into the waste liquid container 53.

In the present embodiment, when the waste liquid container 53 is mounted in the mounting mechanism 54, the direction in which the waste liquid container 53 is moved is defined as a mounting direction X1, and when the waste liquid container 53 mounted in the mounting mechanism 54 is removed, the direction in which the waste liquid container 53 is moved is defined as a removal direction X2. The mounting direction X1 and the removal direction X2 are directions along the X axis and are opposite to each other.

The mounting mechanism 54 is disposed so that the mounting direction X1 in which the waste liquid container 53 is mounted in the housing portion 58 is along the width direction X. The case where the mounting direction X1 is along the width direction X is not limited to the case where the mounting direction X1 and the width direction X are coincident with each other and are the same direction, and includes a case where the mounting direction X1 and the width direction X are parallel and opposite to each other.

The mounting mechanism 54 is provided at a position between the center of the access area AA and the maintenance unit 24 in the width direction X such that a mounting port 60 for mounting the waste liquid container 53 in the housing portion 58 faces the center of the access area AA. The mounting mechanism 54 is disposed at a position where the mounting port 60 opens to the access area AA. The introducing portion 59 is connected to the downstream end of the discharge flow path 51 and is located on the mounting mechanism 54 at a position on the maintenance area MA side of the mounting port 60 in the width direction X.

As illustrated in FIG. 3, the dimension of the access area AA in the width direction X is longer than the dimension of the waste liquid container 53 in the mounting direction X1. Specifically, in the width direction X, the dimension of the access area AA is longer than the dimension of the waste liquid container 53 in the mounted posture in which the waste liquid container 53 is mounted in the housing portion 58. Because the mounting mechanism 54 according to the present embodiment is disposed so that the entirety thereof fits in the access area AA, it is preferable that the dimension of the access area AA in the width direction X be longer than the dimension obtained by adding the dimension of the waste liquid container 53 in the mounting direction X1 and the dimension of the mounting mechanism 54 in the mounting direction X1.

Figure 5:
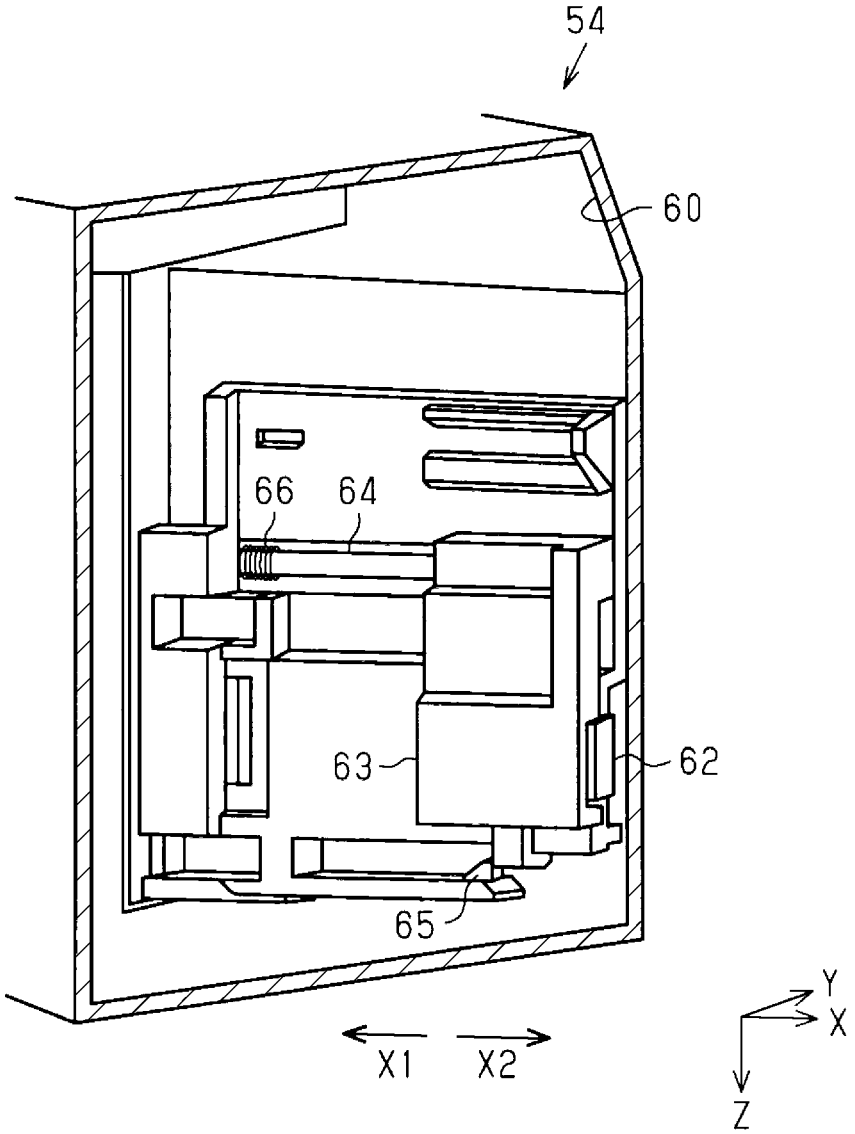
FIG. 5 is a perspective view illustrating the inside of a mounting port of a mounting mechanism.
Figure 6:
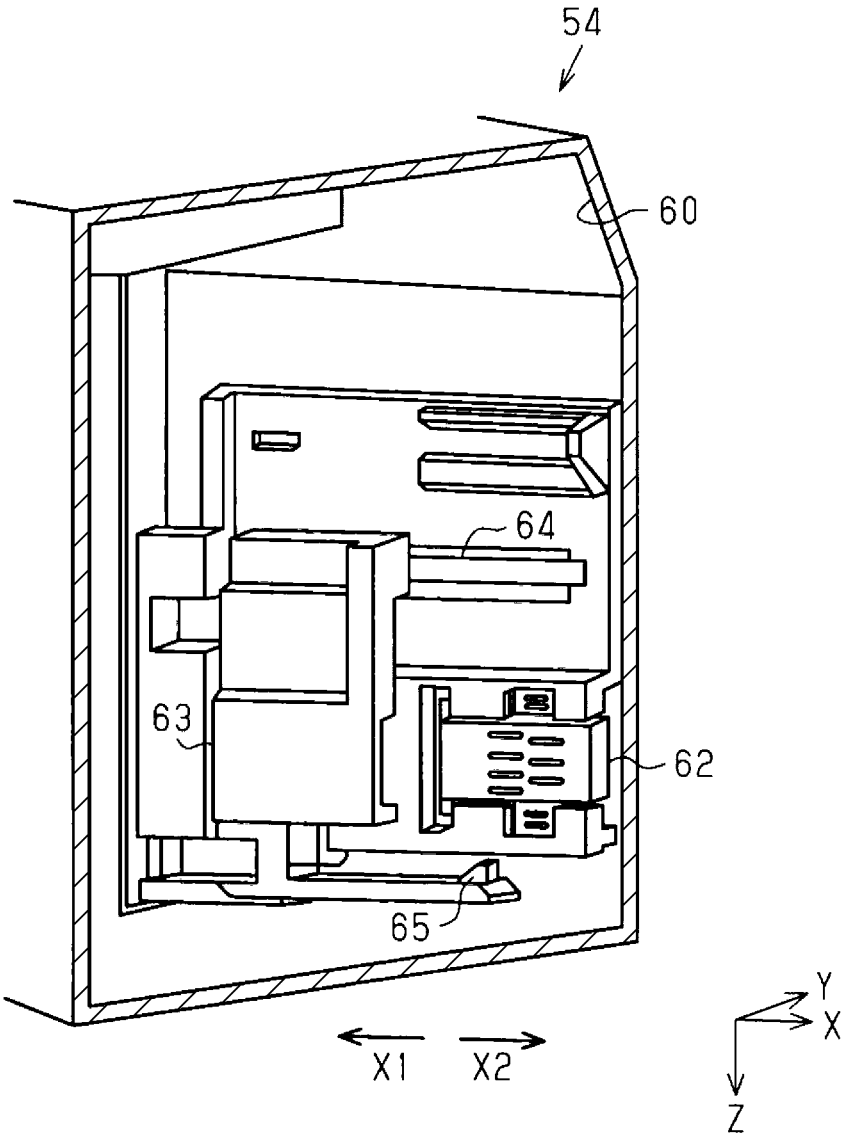
FIG. 6 is a perspective view illustrating the inside of the mounting port of the mounting mechanism.

As illustrated in FIG. 5 and FIG. 6, the mounting mechanism 54 includes an electrical contact portion 62 electrically connected to the control unit 25, a covering portion 63 that covers the electrical contact portion 62, a guide portion 64 that guides the covering portion 63 that moves in the width direction X, and a restriction portion 65 that restricts the movement of the guide portion 64. The mounting mechanism 54 includes an urging member 66 that urges the covering portion 63 located at the open position illustrated in FIG. 6 toward the closed position side illustrated in FIG. 5. The restriction portion 65 engages with the covering portion 63 located at the closed position, and restricts the covering portion 63 located at the closed position from moving to the open position side.

The covering portion 63 is provided so as to be slidably movable between the closed position and the open position. The electrical contact portion 62 is covered by the covering portion 63 positioned at the closed position and the possibility that a waste liquid or the like adheres thereto is reduced. The electrical contact portion 62 is exposed when the covering portion 63 is positioned at the open position. The restriction portion 65 is provided on a cantilever located below the covering portion 63.

Figure 7:
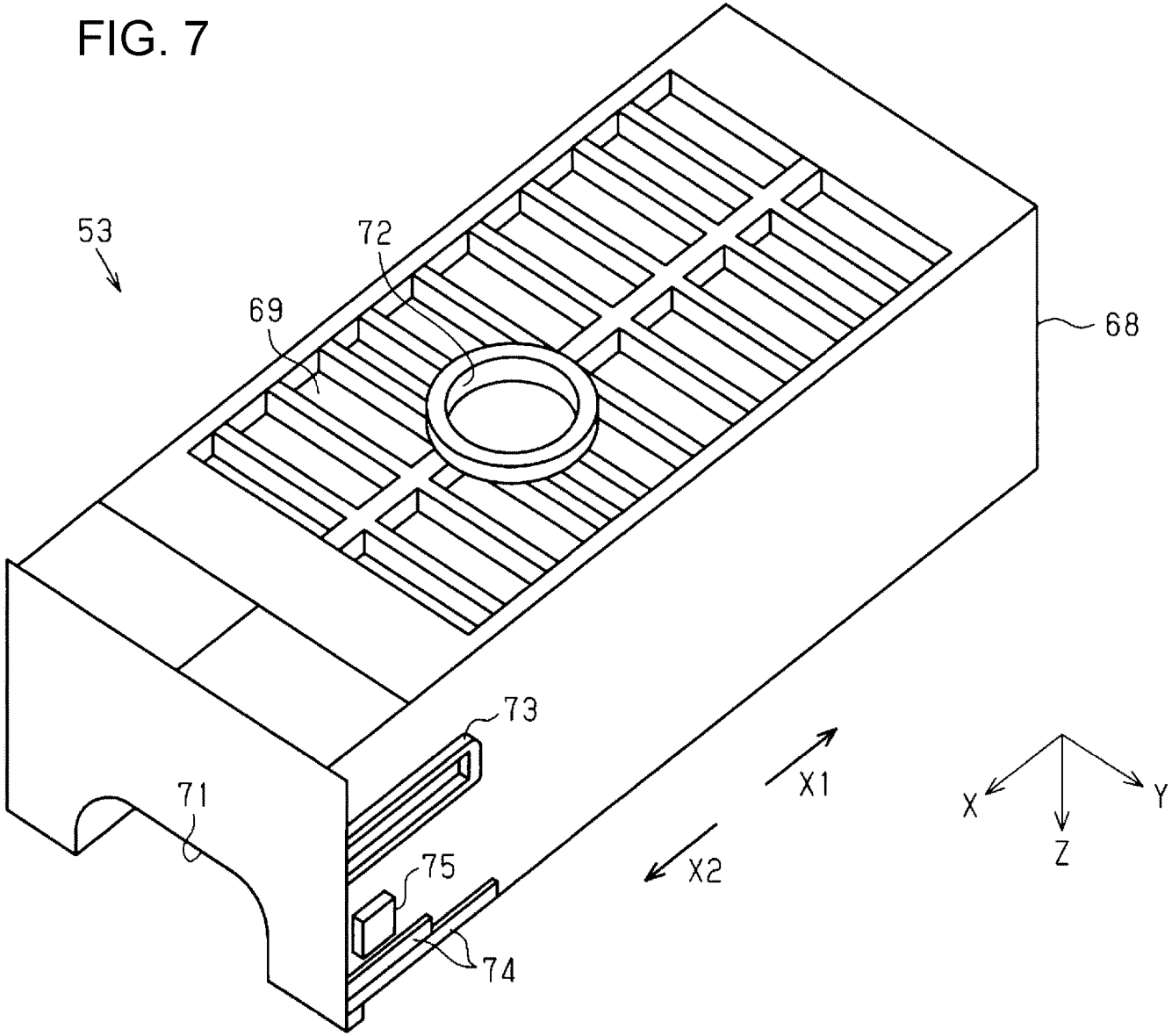
FIG. 7 is a perspective view of a waste liquid container.

As illustrated in FIG. 7, the X axis, the Y axis, and the Z axis of the waste liquid container 53 are illustrated on the basis of a state in which the waste liquid container 53 is mounted in the mounting mechanism 54. The waste liquid container 53 has a substantially rectangular parallelepiped shape and is mounted in the mounting mechanism 54 in a state where the longitudinal direction thereof is aligned with the width direction X.

As illustrated in FIG. 7, the waste liquid container 53 includes, for example, an outer case 68 formed of a hard plastic material in a substantially rectangular parallelepiped shape and an absorbent 69 housed in the outer case 68. The absorbent 69 is formed of, for example, a sponge or a nonwoven fabric capable of absorbing the waste liquid.

A handle 71 for a user to grip is formed at the end of the waste liquid container 53 in the width direction X. The waste liquid container 53 is inserted into the mounting port 60 in the mounting direction X1 from the end opposite to the handle 71 in the width direction X and mounted in the mounting mechanism 54. The waste liquid container 53 mounted in the mounting mechanism 54 is pulled out in the removal direction X2 from the housing portion 58 while the handle 71 is gripped.

A waste liquid inlet 72 having a substantially cylindrical shape that allows the waste liquid to flow into the waste liquid container 53 is formed on the upper surface of the outer case 68. The waste liquid inlet 72 is formed so as to protrude upward from the upper surface of the outer case 68. Therefore, even in the case where bubbles are generated when the waste liquid flows into the waste liquid container 53, when the waste liquid container 53 is pulled out from the mounting mechanism 54, it is possible to scrape off the bubbles of the waste liquid into the waste liquid inlet 72 and it is possible to reduce the possibility of contamination of the waste liquid container 53 and the surroundings.

On a side surface of the outer case 68, a positioning rib 73 extending in the width direction X, a release rib 74, and a circuit board 75 including a memory element are provided. Various types of information on the capacity of the waste liquid container 53 and the like are stored in the memory element of the circuit board 75.

The positioning rib 73 positions the waste liquid container 53 with respect to the mounting mechanism 54 in the case where the waste liquid container 53 is mounted in the mounting mechanism 54. In the case where the waste liquid container 53 is mounted in the mounting mechanism 54, the release rib 74 releases the movement restriction of the covering portion 63 by the restriction portion 65, and pushes the covering portion 63 located at the closed position toward the open position side.

Specifically, when the waste liquid container 53 is mounted, the release rib 74 engages with the restriction portion 65 and moves the restriction portion 65 away from the covering portion 63. As a result, the restriction portion 65 and the covering portion 63 are disengaged from each other and the covering portion 63 becomes movable. Therefore, it is preferable that the tip of the release rib 74 in the mounting direction X1 and the end of the restriction portion 65 on the mounting port 60 side be inclined.

Next, the operation of the liquid ejecting apparatus 11 will be described.

As illustrated in FIG. 4, when the waste liquid container 53 is mounted in the mounting mechanism 54 or the waste liquid container 53 is replaced, the front surface cover 16 is positioned at the open position. When the front surface cover 16 is positioned at the open position, the access area AA can be accessed from the apparatus front side.

As illustrated in FIG. 3, when the waste liquid container 53 is mounted in the mounting mechanism 54, the user arranges the waste liquid container 53 in the access area AA so as to be aligned with the mounting mechanism 54 in the width direction X as indicated by a two-dot chain line in FIG. 3. From this state, the user moves the waste liquid container 53 in the mounting direction X1 and inserts the waste liquid container 53 from the mounting port 60 into the housing portion 58.

As illustrated in FIG. 4, when the waste liquid container 53 is mounted in the mounting mechanism 54, the covering portion 63 moves from the closed position to the open position, and the electrical contact portion 62 and the circuit board 75 are electrically connected to each other. By electrically connecting the circuit board 75 and the electrical contact portion 62 to each other, various types of information are transferred between the circuit board 75 of the waste liquid container 53 and the control unit 25. The information transferred includes, for example, the start date of use of the waste liquid container 53, the integrated value of the discharge amount of the waste liquid, and the like.

In the waste liquid container 53 mounted in the mounting mechanism 54, the waste liquid inlet 72 is located below the introducing portion 59. Therefore, a waste liquid discharged in accordance with a maintenance operation or a printing operation is housed in the waste liquid container 53 via the discharge flow path 51, the introducing portion 59, and the waste liquid inlet 72, and is absorbed by the absorbent 69.

When the waste liquid container 53 mounted in the mounting mechanism 54 is removed, the covering portion 63 is urged by the urging member 66 and moves from the open position to the closed position. When the release rib 74 separates from the restriction portion 65, the restriction portion 65 engages with the covering portion 63 located at the closed position and restricts the movement of the covering portion 63.

According to the first embodiment, the following effects can be obtained.

1-1 The mounting port 60 for mounting the waste liquid container 53 in the mounting mechanism 54 opens to the access area AA accessible from the apparatus front side. Therefore, regardless of the installation state of the liquid ejecting apparatus 11, the waste liquid container 53 can be easily mounted in the mounting mechanism 54.

1-2 The mounting direction X1 of the waste liquid container 53 is along the width direction X of the medium MS. The dimension of the access area AA in the width direction X is longer than the dimension of the waste liquid container 53 in the mounting direction X1. Therefore, by moving the waste liquid container 53 located in the access area AA in the mounting direction X1, the waste liquid container 53 can be mounted in the mounting mechanism 54.

1-3 The dimension of the access area AA in the width direction X is longer than a dimension obtained by adding the dimension of the waste liquid container 53 in the mounting direction X1 and the dimension of the mounting mechanism 54 in the mounting direction X1. Therefore, even when the mounting mechanism 54 is disposed in the access area AA, the waste liquid container 53 can be mounted in the mounting mechanism 54 by moving the waste liquid container 53 located in the access area AA in the mounting direction X1.

1-4 The introducing portion 59 for introducing a portion of the liquid discharged as a waste liquid into the waste liquid container 53 is located on the maintenance area MA side of the mounting port 60 in the width direction X. Therefore, as compared with the case where the introducing portion 59 is located on the opposite side to the maintenance area MA side of the mounting port 60, the maintenance unit 24 and the introducing portion 59 can be brought closer to each other and the waste liquid can be easily guided from the maintenance unit 24 to the introducing portion 59.

1-5 The liquid ejecting apparatus 11 includes the front surface cover 16 disposed on the apparatus front side of the access area AA. Therefore, when the waste liquid container 53 is to be mounted in the mounting mechanism 54, the access area AA can be accessed from the apparatus front side by positioning the front surface cover 16 at the open position. When the waste liquid container 53 is not being mounted in the mounting mechanism 54, the liquid ejecting apparatus 11 can be improved in appearance by positioning the front surface cover 16 at the closed position and covering the waste liquid container 53 and the mounting mechanism 54.

Second Embodiment

Next, a second embodiment of a liquid ejecting apparatus will be described with reference to the drawings. This second embodiment is different from the first embodiment in that the mounting mechanism is rotatably provided, and is otherwise substantially the same as the first embodiment in other respects. Therefore, the same reference numerals are given to the same components, and duplicate explanation will be omitted.

Figure 8:
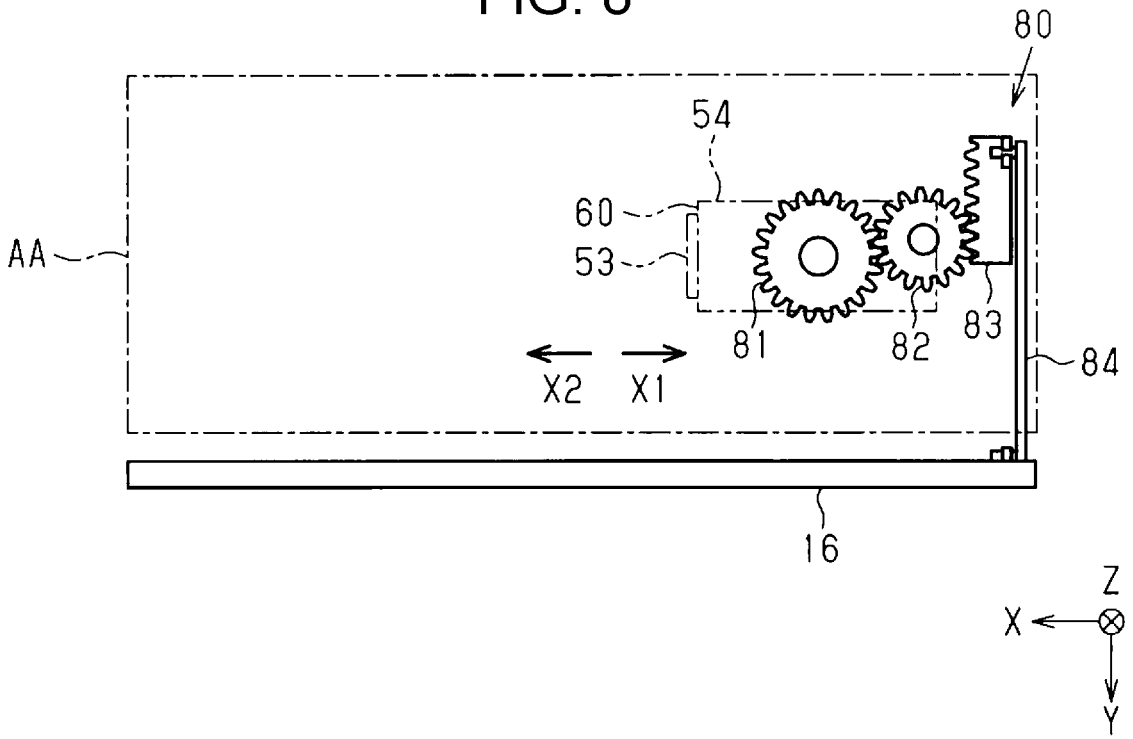
FIG. 8 is a schematic plan view illustrating an internal configuration of a liquid ejecting apparatus according to a second embodiment.

As illustrated in FIG. 8, the liquid ejecting apparatus 11 includes a rotation mechanism 80 that rotates the mounting mechanism 54. The rotation mechanism 80 includes a gear 81 fixed to the mounting mechanism 54, a pinion 82 meshed with the gear 81, a rack 83 engaged with the pinion 82, and an arm 84 connecting the rack 83 and the front surface cover 16. The gear 81 and the pinion 82 are provided rotatably about the respective axes thereof. The axis of the gear 81 preferably coincides with the center of gravity of the mounting mechanism 54. The rack 83 is slidably provided in the transport direction Y.

Next, the operation of the liquid ejecting apparatus 11 will be described.

As illustrated in FIG. 8, when the front surface cover 16 is in the closed position, the mounting mechanism 54 takes a housing mode. In the housing mode, the mounting port 60 opens in the width direction X and the mounting direction X1 is along the width direction X.

Figure 9:
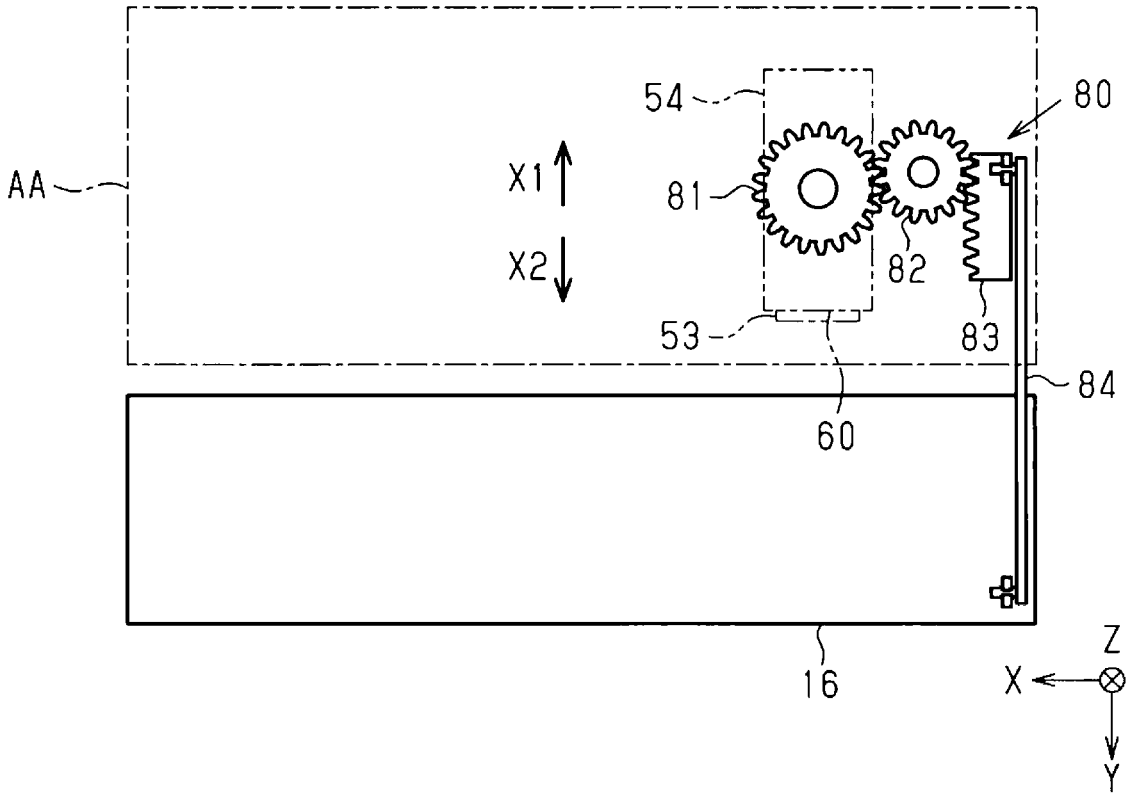
FIG. 9 is a schematic plan view illustrating a state in which the mounting mechanism of FIG. 8 is in a mounting mode.

As illustrated in FIG. 9, when the front surface cover 16 is positioned at the open position, the rack 83 connected to the front surface cover 16 by the arm 84 moves forward so as to approach the front surface cover 16. When the rack 83 moves, the pinion 82, the gear 81, and the mounting mechanism 54 fixed to the gear 81 rotate. More specifically, when the front surface cover 16 moves from the closed position to the open position, the mounting mechanism 54 of the present embodiment rotates counterclockwise by 90 degrees, and, when the front surface cover 16 is in the open position, the mounting mechanism 54 takes the mounting mode. In the mounting mode, the mounting direction X1 is along the transport direction Y and the mounting port 60 opens to the apparatus front side.

When the front surface cover 16 positioned at the open position is moved to the closed position, the rack 83 moves rearward away from the front surface cover 16. When the rack 83 moves, the mounting mechanism 54 rotates 90 degrees in the clockwise direction and returns from the mounting mode to the housing mode.

According to the second embodiment, in addition to the effects of the first embodiment, the following effects can be obtained.

2-1 In the liquid ejecting apparatus 11, the mode of the mounting mechanism 54 changes according to the position of the front surface cover 16. That is, when the front surface cover 16 is in the closed position, the mounting mechanism 54 takes the housing mode in which the mounting direction X1 is along the width direction X, and, when the front surface cover 16 is in the open position, the mounting port 60 opens to the apparatus front side. Therefore, even in the case where the mounting mechanism 54, for example, is arranged in the housing mode in accordance with the space in the liquid ejecting apparatus 11, by putting the front surface cover 16 in the open position, it is possible to set the mounting mechanism 54 to the mounting mode. Therefore, because the waste liquid container 53 can be mounted in the mounting mechanism 54 from the apparatus front side, the waste liquid container 53 can be mounted in the mounting mechanism 54 more easily.

The above embodiments may be modified as in the following modification example. The above embodiments and the following modification example may be arbitrarily combined. The configurations included in the following modification example may be arbitrarily combined.

First Modification Example

Figure 10:
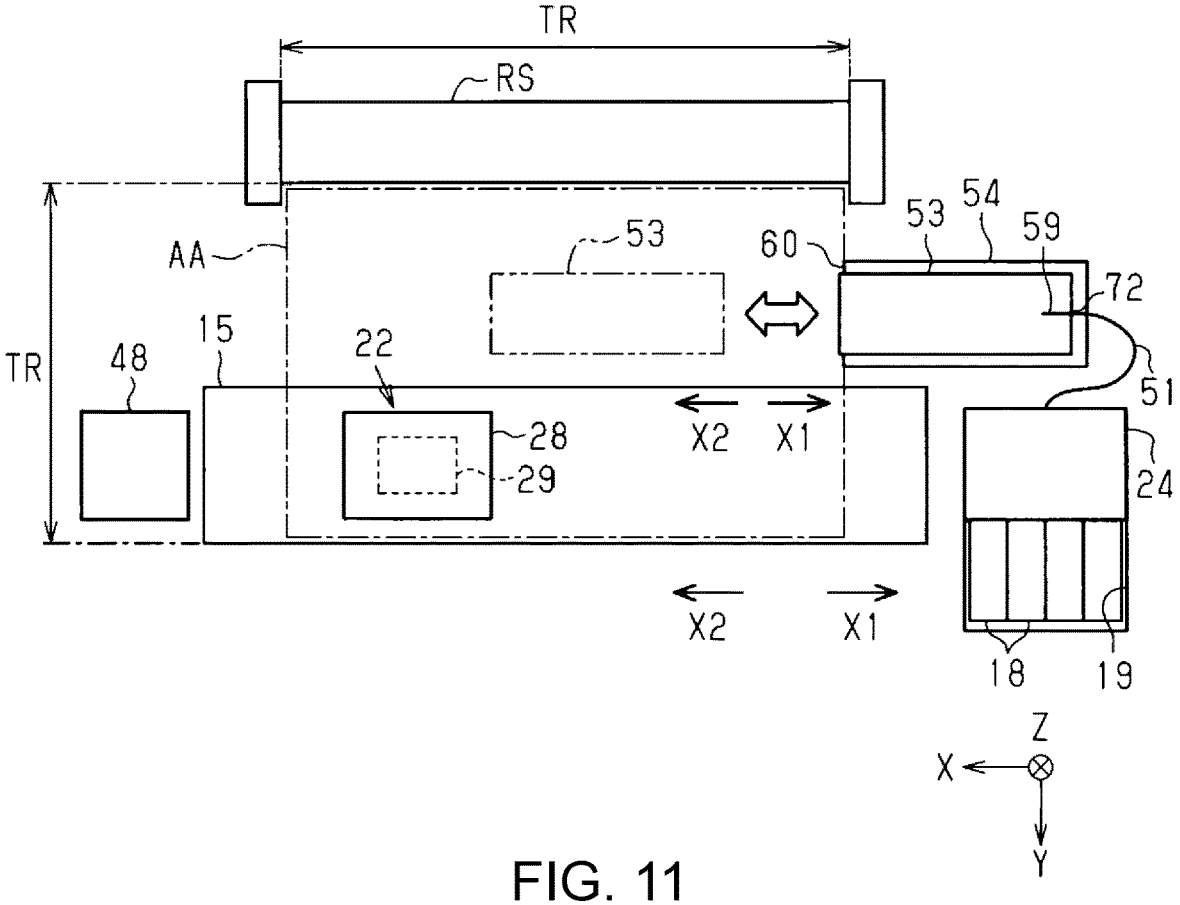
FIG. 10 is a schematic plan view illustrating an internal configuration of the liquid ejecting apparatus of a first modification.
Figure 11:
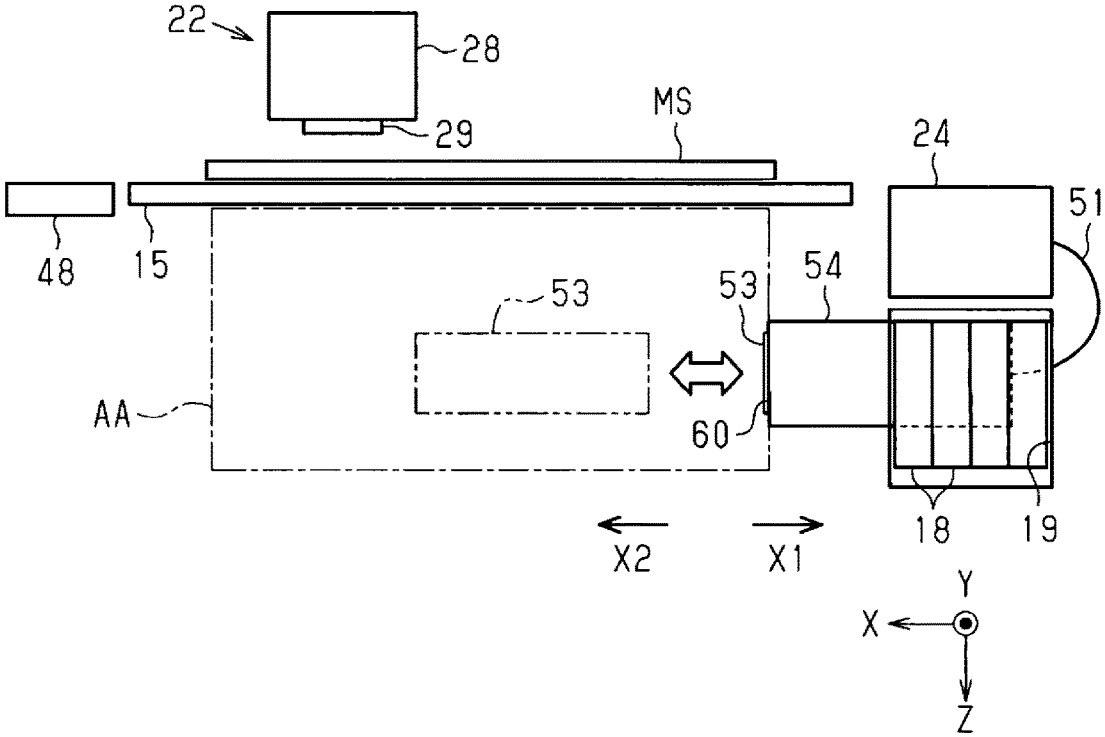
FIG. 11 is a schematic front view illustrating the internal configuration of the liquid ejecting apparatus of FIG. 10.
Figure 12:
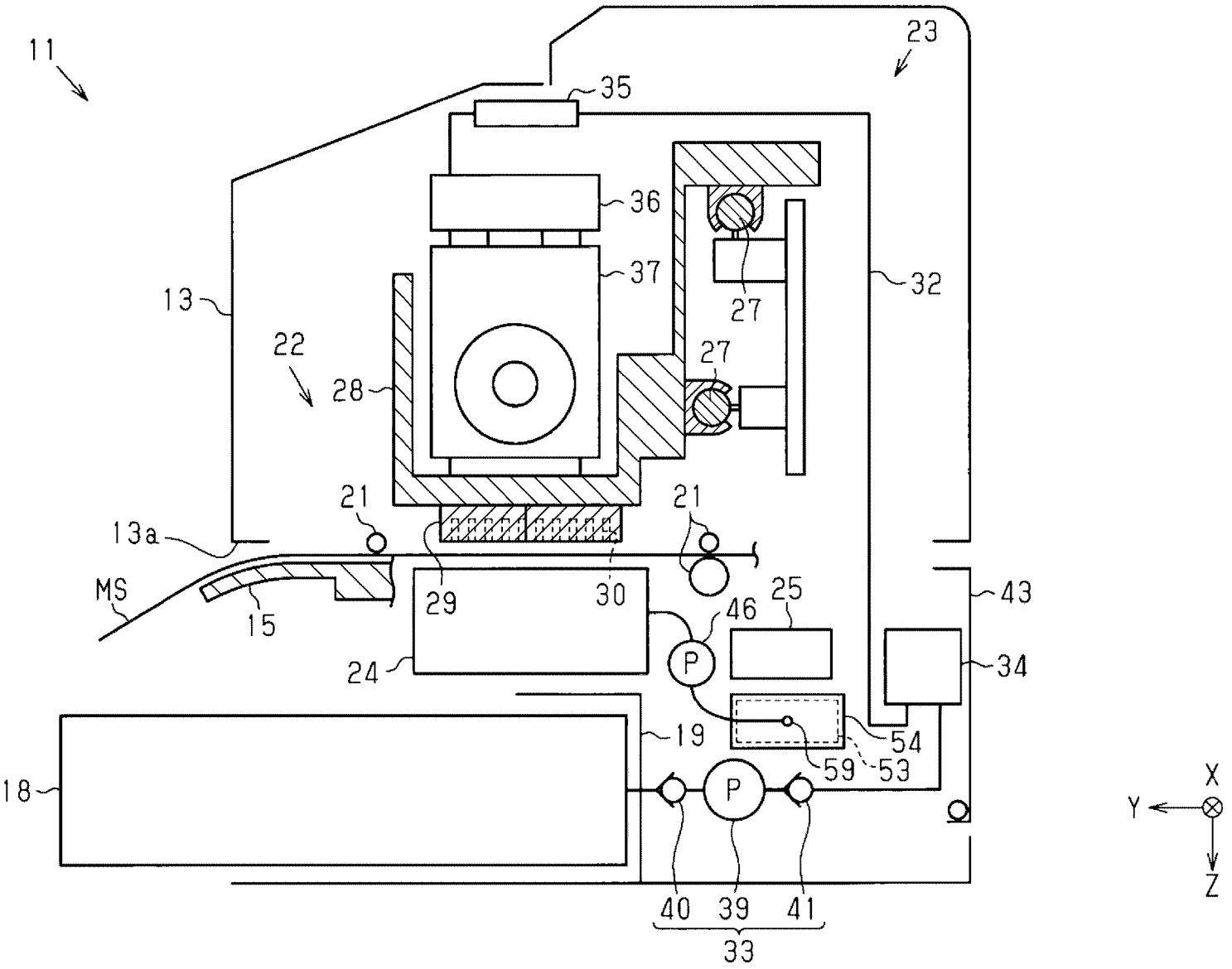
FIG. 12 is a schematic side view illustrating the internal configuration of the liquid ejecting apparatus of FIG. 10.

As illustrated in FIG. 10 and FIG. 11, the mounting mechanism 54 may be disposed so that a portion thereof is located outside the access area AA as long as the mounting port 60 opens to the access area AA. As illustrated in FIG. 10 and FIG. 12, for example, the mounting mechanism 54 may be disposed on the apparatus rear side of the housing of the container holding portion 19, and the waste liquid container 53 may be detached from the access area AA at the mounting port 60 that opens to the access area AA.

As illustrated in FIG. 10 to FIG. 12, the introducing portion 59 may be provided on the rear side of the mounting mechanism 54 in the mounting direction X1. The waste liquid inlet 72 may be formed on the front side of the waste liquid container 53 in the mounting direction X1. The waste liquid container 53 may be mounted in the mounting mechanism 54 so that the introducing portion 59 is inserted into the waste liquid inlet 72.

In the second embodiment, the rotation mechanism 80 may be formed without the arm 84. That is, it is not necessary for the mounting mechanism 54 to rotate in conjunction with the movement of the front surface cover 16. The rotation mechanism 80 may include a driving source such as a motor, and the waste liquid container 53 may be rotated by the driving force of the driving source.

In the second embodiment, the liquid ejecting apparatus 11 may not include the rotation mechanism 80. In the liquid ejecting apparatus 11, the mounting mechanism 54 may be rotatably provided, and the user may directly rotate the mounting mechanism 54.

The liquid ejecting apparatus 11 may be provided with a plurality of the mounting mechanisms 54 and a plurality of the waste liquid containers 53 may be mountable therein. For example, the liquid ejecting apparatus 11 may include two mounting mechanisms 54 arranged in the width direction X so that mounting ports 60 face each other. At this time, it is preferable that the interval of the two mounting mechanisms 54 in the width direction X be longer than the dimension of the waste liquid container 53 in the mounting direction X1. The plurality of the mounting mechanisms 54 may be disposed so as to be aligned in the transport direction Y.

A plurality of the waste liquid containers 53 may be mountable in the mounting mechanism 54.

The waste liquid containers 53 may house the waste liquid discharged by at least one operation among the waste liquids discharged by the borderless printing operation, the suction cleaning operation, and the flushing operation. For example, the liquid ejecting apparatus 11 may separately include the mounting mechanism 54 in which the waste liquid container 53 that houses the waste liquid discharged in accordance with the borderless printing operation is mounted, and the mounting mechanism 54 in which the waste liquid container 53 that houses the waste liquids discharged in accordance with the suction cleaning operation and the flushing operation is mounted. The waste liquid generated by the flushing operation may be retained in the flushing unit 48 without connecting the discharge flow path 51 to the flushing unit 48. The waste liquid generated by the borderless printing operation may be retained in the liquid receiving portion 15*b*.

The flushing unit 48 may be detachable. The mounting portion in which the flushing unit 48 is mounted may open to the access area AA. According to this configuration, the flushing unit 48 is detachable from the apparatus front side via the access area AA.

The filter unit 34 may be disposed in the access area AA and may be detachable from the apparatus front side via the access area AA. In this case, the liquid ejecting apparatus 11 may be formed without the rear surface cover 43.

The liquid ejecting apparatus 11 may be formed without the front surface cover 16.

The front surface cover 16 may cover a portion of the access area AA.

The front surface cover 16 may be, for example, a shutter that winds upward, or it may be a door that slides upward and downward.

The introducing portion 59 may be located on the opposite side to the maintenance area MA side of the mounting port 60.

The dimension of the access area AA in the width direction X may be the same as or smaller than a dimension obtained by adding the dimension of the waste liquid container 53 in the mounting direction X1 and the dimension of the mounting mechanism 54 in the mounting direction X1.

The dimension of the access area AA in the width direction X may be the same as or smaller than the dimension of the waste liquid container 53 in the mounting direction X1.

The mounting mechanism 54 may be disposed so that the mounting direction X1 intersects the width direction X and the transport direction Y.

The mounting mechanism 54 may be disposed so that the mounting direction X1 is along the transport direction Y as long as the mounting port 60 opens to the access area AA.

In the above embodiment, the liquid ejecting apparatus 11 may be a liquid ejecting apparatus that ejects or discharges a liquid other than ink. Further, note that the liquid discharged as a minute amount of liquid droplets from the liquid jetting apparatus may have any of a grain shape, a teardrop shape, and a thread-like tail shape. In addition, the liquid referred to here may be any material as long as it can be ejected from the liquid ejecting apparatus. For example, the material may have any state as long as the substance is in a liquid phase, and it may be a liquid material having high or low viscosity, a sol, gel water, another inorganic solvent, an organic solvent, a solution, a liquid resin, or a liquid metal (metal melt). In addition, not only a liquid as one state of a substance, but also substances in which particles of a functional material composed of a solid material such as pigments and metal particles are dissolved, dispersed or mixed in a solvent, and the like are included. Representative examples of the liquid include ink as described in the above embodiment, liquid crystals, and the like. Here, examples of "ink" include various types of liquid compositions such as general water-based ink and oil-based ink, gel ink, hot melt ink and the like. A specific example of the liquid ejecting apparatus is a liquid ejecting apparatus that ejects a liquid containing dispersed or dissolved materials such as electrode materials and coloring materials used for manufacturing liquid crystal displays, EL (electroluminescence) displays, surface emitting displays, color filters, and the like. In addition, the liquid ejecting apparatus may be a liquid ejecting apparatus that ejects a bioorganic material used for biochip production, a liquid ejecting apparatus that is used as a precision pipette and ejects a liquid as a sample, a textile printing apparatus, a microdispenser, or the like. Furthermore, the liquid ejecting apparatus may be a liquid ejecting apparatus that ejects lubricating oil with pinpoint accuracy to a precision machine such as a watch or a camera, or a liquid ejecting apparatus that ejects a transparent resin liquid such as an ultraviolet curable resin liquid onto a substrate to form a micro hemispherical lens (optical lens) or the like used for an optical communication element or the like. In addition, the liquid ejecting apparatus may be a liquid ejecting apparatus that ejects an etching solution such as an acid or an alkali to etch a substrate or the like.

Technical ideas grasped from the above-described embodiments and modifications and their operational effects will be described below.

Idea 1

A liquid ejecting apparatus includes a liquid ejecting head that has a nozzle that ejects a liquid onto a medium; a maintenance unit that performs a maintenance operation for the liquid ejecting head; a mounting mechanism in which is mounted a waste liquid container that houses a portion of the liquid discharged as a waste liquid from the liquid ejecting head; and an access area that is provided vertically below a transport path along which the medium is transported and that is accessible from an apparatus front side, which is a downstream side in a transport direction in which the medium is transported, the mounting mechanism including a housing portion that houses the waste liquid container and being disposed so that a mounting port for mounting the waste liquid container in the housing portion opens to the access area.

According to this configuration, the mounting port for mounting the waste liquid container in the mounting mechanism opens to an access area accessible from the apparatus front side. Therefore, regardless of an installation state of the liquid ejecting apparatus, the waste liquid container can be easily mounted in the mounting mechanism.

Idea 2

In the liquid ejecting apparatus according to Idea 1, the mounting mechanism is disposed such that a mounting direction in which the waste liquid container is mounted in the housing portion is along a width direction perpendicular to the transport direction of the medium, and a dimension of the access area in the width direction is longer than a dimension of the waste liquid container in the mounting direction.

According to this configuration, the mounting direction of the waste liquid container is along the width direction of the medium. The dimension of the access area in the width direction is longer than the dimension of the waste liquid container in the mounting direction. Therefore, by moving the waste liquid container located in the access area in the mounting direction, the waste liquid container can be mounted in the mounting mechanism.

Idea 3

In the liquid ejecting apparatus according to Idea 2, the mounting mechanism is disposed in the access area, and the dimension of the access area in the width direction is longer than a dimension obtained by adding the dimension of the waste liquid container in the mounting direction and a dimension of the mounting mechanism in the mounting direction.

According to this configuration, the dimension of the access area in the width direction is longer than the dimension obtained by adding the dimension of the waste liquid container in the mounting direction and the dimension of the mounting mechanism in the mounting direction. Therefore, even when the mounting mechanism is disposed in the access area, it is possible to mount the waste liquid container in the mounting mechanism by moving the waste liquid container disposed in the access area in the mounting direction.

Idea 4

In the liquid ejecting apparatus according to Idea 2 or Idea 3, the maintenance unit is disposed in a maintenance area adjacent in the width direction to an ejection area in which the liquid ejecting head ejects the liquid to the medium, and the mounting mechanism has an introducing portion that introduces the portion of the liquid discharged as the waste liquid into the waste liquid container at a position that is on a maintenance area side of the mounting port in the width direction.

According to this configuration, the introducing portion that introduces the portion of the liquid discharged as the waste liquid into the waste liquid container is positioned on the maintenance area side of the mounting port in the width direction. Therefore, as compared with the case where the introducing portion is positioned on the opposite side to the maintenance area side of the mounting port, the maintenance unit and the introducing portion can be brought closer to each other, and the waste liquid can be easily guided from the maintenance unit to the introducing portion.

Idea 5

The liquid ejecting apparatus according to any one of Idea 1 to Idea 4 further includes a cover disposed on the apparatus front side of the access area, the cover being positioned in a closed position covering the access area from the apparatus front side and an open position enabling access to the access area.

According to this configuration, there is provided a cover arranged on the apparatus front side of the access area. Therefore, when the waste liquid container is mounted in the mounting mechanism, the access area can be accessed from the apparatus front side by positioning the cover at the open position. When the waste liquid container is not mounted in the mounting mechanism, the cover can be positioned at the closed position to cover the waste liquid container and the mounting mechanism, thereby improving the appearance of the liquid ejecting apparatus.

Idea 6

In the liquid ejecting apparatus according to Idea 5, the mounting mechanism takes a housing mode when the cover is in the closed position and takes a mounting mode when the cover is in the open position, the housing mode is a mode in which a mounting direction in which the waste liquid container is mounted in the housing portion is along a width direction perpendicular to the transport direction of the medium, and the mounting mode is a mode in which the mounting direction is along the transport direction and the mounting port opens to the apparatus front side.

According to this configuration, the mode of the mounting mechanism changes depending on the position of the cover. That is, when the cover is in the closed position, the mounting mechanism takes a housing mode in which the mounting direction is along the width direction, and when the cover is in the open position, the mounting port opens to the apparatus front side. Therefore, even in the case where the mounting mechanism, for example, is disposed in the housing mode in accordance with the space inside the liquid ejecting apparatus, by putting the cover in the open position, it is possible to set the mounting mechanism to the mounting mode. Therefore, because the waste liquid container can be mounted in the mounting mechanism from the apparatus front side, the waste liquid container can be mounted in the mounting mechanism more easily.

The entire disclosure of Japanese Patent Application No. 2018-023187, filed Feb. 13, 2018 is expressly incorporated by reference herein.

What is claimed is:

1. A liquid ejecting apparatus comprising:

a liquid ejecting head configured to eject a liquid onto a medium;

a maintenance unit that performs a maintenance operation for the liquid ejecting head;

a mounting mechanism in which is mounted a waste liquid container that houses a portion of the liquid discharged as a waste liquid from the liquid ejecting head; and an access area that is provided vertically below a transport path along which the medium is transported and that is accessible from an apparatus front side, which is a downstream side in a transport direction in which the medium is transported, wherein the mounting mechanism includes a housing portion that houses the waste liquid container and is disposed so that a mounting port for mounting the waste liquid container in the housing portion opens to the access area by having the mounting port be oriented in a width direction of the liquid ejecting apparatus.

2. The liquid ejecting apparatus according to claim 1, wherein the mounting mechanism is disposed such that a mounting direction in which the waste liquid container is mounted in the housing portion is along a width direction perpendicular to the transport direction of the medium, and wherein a dimension of the access area in the width direction is longer than a dimension of the waste liquid container in the mounting direction.

3. The liquid ejecting apparatus according to claim 2, wherein the mounting mechanism is disposed in the access area, and wherein the dimension of the access area in the width direction is longer than a dimension obtained by adding the dimension of the waste liquid container in the mounting direction and a dimension of the mounting mechanism in the mounting direction.

4. The liquid ejecting apparatus according to claim 1, wherein the maintenance unit is disposed in a maintenance area adjacent in the width direction to an ejection area in which the liquid ejecting head ejects the liquid to the medium, and wherein the mounting mechanism has an introducing portion that introduces the portion of the liquid discharged as the waste liquid into the waste liquid container at a position that is on a maintenance area side of the mounting port in the width direction.

5. The liquid ejecting apparatus according to claim 1, further comprising a cover disposed on the apparatus front side of the access area, wherein the cover is configured to be positioned in a closed position covering the access area from the apparatus front side and an open position enabling access to the access area.

6. The liquid ejecting apparatus according to claim 5, wherein the mounting mechanism takes a housing mode when the cover is in the closed position and takes a mounting mode when the cover is in the open position, wherein the housing mode is a mode in which a mounting direction in which the waste liquid container is mounted in the housing portion is along a width direction perpendicular to the transport direction of the medium, and wherein the mounting mode is a mode in which the mounting direction is along the transport direction and the mounting port opens to the apparatus front side.

7. A liquid ejecting apparatus comprising:

a liquid ejecting head configured to eject a liquid onto a medium;

a maintenance unit that performs a maintenance operation for the liquid ejecting head;

a mounting mechanism in which is mounted a waste liquid container that houses a portion of the liquid discharged as a waste liquid from the liquid ejecting head;

an access area that is provided vertically below a transport path along which the medium is transported and that is accessible from an apparatus front side, which is a downstream side in a transport direction in which the medium is transported; and a cover disposed on the apparatus front side of the access area, wherein the cover is configured to be positioned in a closed position covering the access area from the apparatus front side and an open position enabling access to the access area, wherein the mounting mechanism includes a housing portion that houses the waste liquid container and is disposed so that a mounting port for mounting the waste liquid container in the housing portion opens to the access area, wherein the mounting mechanism takes a housing mode when the cover is in the closed position and takes a mounting mode when the cover is in the open position, wherein the housing mode is a mode in which a mounting direction in which the waste liquid container is mounted in the housing portion is along a width direction perpendicular to the transport direction of the medium, and wherein the mounting mode is a mode in which the mounting direction is along the transport direction and the mounting port opens to the apparatus front side.

* * * * *